United States Patent [19]

Bachman et al.

[11] Patent Number: 4,466,614

[45] Date of Patent: Aug. 21, 1984

[54] GAME WITH SELECTABLE PLAYING AREAS

[75] Inventors: Gilbert Bachman; Gabriel H. Weaver, both of Atlanta, Ga.

[73] Assignee: Dittler Brothers, Inc., Atlanta, Ga.

[21] Appl. No.: 406,106

[22] Filed: Aug. 6, 1982

[51] Int. Cl.[3] ..... A63F 9/18; G09B 3/08

[52] U.S. Cl. ..... 273/139; 273/272; 434/346

[58] Field of Search ..... 273/138 R, 139, 272, 273/1 R; 434/346; 283/100–104

[56] References Cited

U.S. PATENT DOCUMENTS 3,918,174 11/1975 Miller et al. ..... 283/102

OTHER PUBLICATIONS

The Great Guinness Game.

*Primary Examiner*—Paul E. Shapiro

*Attorney, Agent, or Firm*—Jones & Askew

[57] ABSTRACT

A game comprising a playing surface having first indicia thereon defining a plurality of game symbols. Second indicia on the playing surface define a plurality of game categories. The second indicia is arranged on the playing surface so that the game symbols are in spaced relationship with the game categories. Third indicia on the playing surface define a plurality of playing areas. Each playing area is in spaced register with one of the game symbols and one of the game categories so that selection of one of the playing areas associates the playing symbol with the game category. The game symbols are chosen and arranged with respect to the game categories and playing areas so that at least one desired combination of selected ones of the game symbols is associatable with each game category and at least one desired combination of playing areas associates all of the game symbols with the game categories.

20 Claims, 3 Drawing Figures

GAME WITH SELECTABLE PLAYING AREAS

FIELD

The present invention relates to games, and, more particularly, to games wherein a player can select one solution or one best solution to the game from a number of possible solutions involving elements of skill.

BACKGROUND

Throughout the consumer products industry, especially the fast food industry, advertisers and marketing experts have begun to rely heavily on the use of contest games to entice the public to eat in their establishments or to buy their products. One such popular contest is that utilizing game cards wherein the recipient answers a multiple choice question to become an "Instant Winner." Typically, the game cards have printed thereon a question below which is printed several possible answers. Associated with each possible answer is a removable masking layer. The player selects the proper answer by removing the masking layer associated with the answer he chooses to select. When the masking layer is removed, indicia printed on the game card is revealed indicating whether the player has made the correct selection of possible answers. If the correct selection is made, the card can be redeemed for the appropriate prize. Such games involve an element of skill to select the correct answer in order to produce a winning game card. U.S. Pat. No. 3,918,174 (incorporated herein by reference) to Miller is an example of such a game.

Another similar game employs a plurality of indicia printed on the game card. The indicia are individually hidden under removable masking layers. The game permits the removal of a given number of masks, such as three. When the masks are removed the underlying indicia are revealed. If the exposed indicia correspond to a desired combination of indicia, the card is a winner and can be redeemed for the appropriate prize. This type of game involves an element of chance in order to produce a winning game card.

New games to capture the imagination of the consuming public are constantly being sought.

SUMMARY OF INVENTION

The present invention relates to a game comprising a playing surface having first indicia thereon defining a plurality of game symbols. Second indicia on the playing surface define a plurality of game categories. The second indicia is arranged on the playing surface so that the game symbols are in spaced relationship with the game categories. Third indicia on the playing surface define a plurality of playing areas. Each playing area is in spaced register with one of the game symbols and one of the game categories so that selection of one of the playing areas associates the playing symbol with the game category. The game symbols are chosen and arranged with respect to the game categories and playing areas so that at least one desired combination of selected ones of the game symbols is associatable with each game category and at least one desired combination of playing area associates all of the game symbols with the game categories.

Accordingly, it is an object of the present invention to provide an improved game.

Another object of the present invention is to provide a game employing elements of skill, elements of chance or a combination of both.

A further object of the present invention is to provide a game which has a number of possible solutions and a player can select the one solution or the one best solution therefrom.

These and other objects, features and advantages of the present invention will become apparent after a review of the following detailed description of the disclosed embodiment and the appended drawing and claims.

DETAILED DESCRIPTION OF THE DISCLOSED EMBODIMENTS

Figure 1:
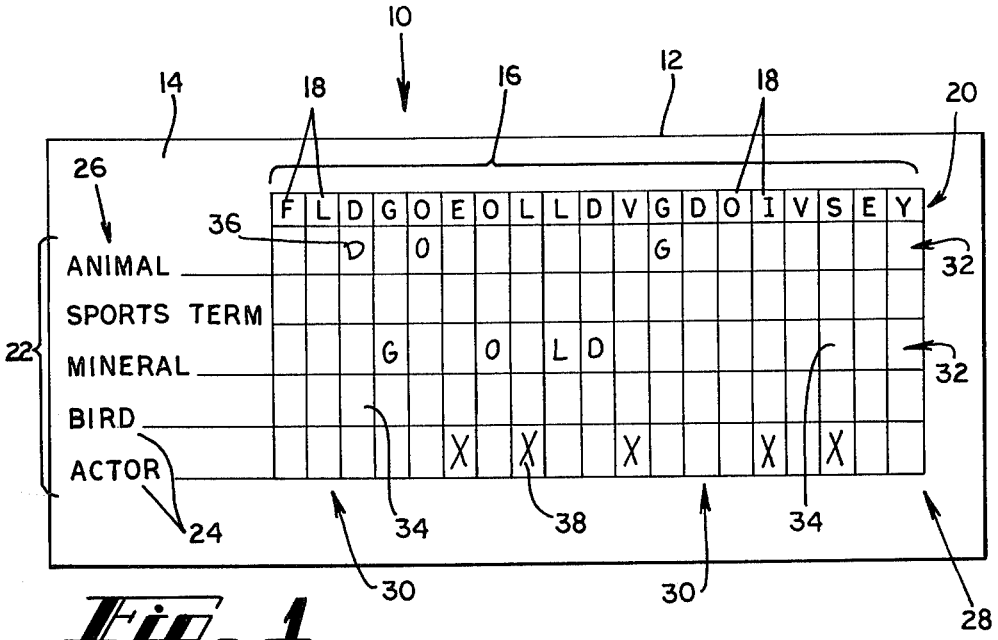
FIG. 1 is a front view of a disclosed embodiment of the game of the present invention.

Referring now to the drawing in which like numbers indicate like elements throughout the several views, it will be seen that there is a game 10 in accordance with the present invention. The game comprises a game card 12 having a playing surface 14. The game card 12 can be made of any suitable material, such as a card stock material.

Figure 2:
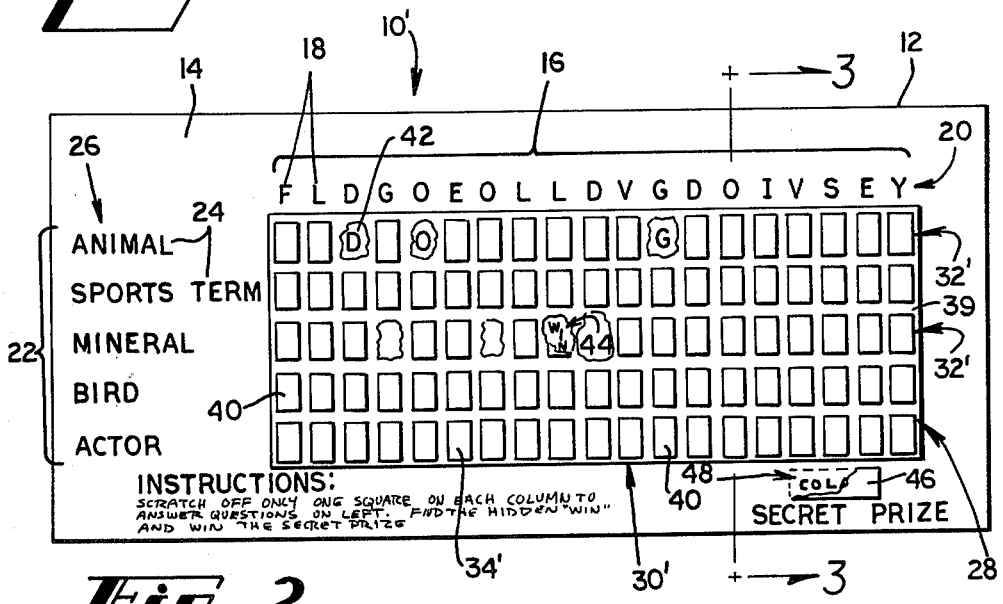
FIG. 2 is a front view of another disclosed embodiment of the game of the present invention shown with some of the masks removed or partially broken away.

Printed on the playing surface 14 is a first grouping of indicia 16. This first indicia 16 comprises several letters 18 of the alphabet arranged in a horizontal row 20. As shown in FIGS. 1 and 2, the letters 18, when read from left to right are: "F," "L," "D," "G," "E," "O," "L," "L," "D," "V," "G," "D," "O," "I," "V," "S," "E" and "Y." The letters 18 appear to be randomly arranged so that no discernable words can be recognized. However, the letters 18 are actually chosen and arranged in a specific pattern, as will be explained more completely hereinbelow. Although the first indicia 16 has been described as comprising letters of the alphabet, it is specifically contemplated that other types of game symbols can also be used.

Also printed on the playing surface 14 is a grouping of second indicia 22. The second indicia 22 define several words or game categories 24 with which the game symbols are to be matched. The game categories 24 are arranged in a vertical column 26. As shown in FIGS. 1 and 2, the game categories 24, when read from top to bottom, are "ANIMAL", "SPORTS TERM," "MINERAL," "BIRD" and "ACTOR." The game categories 24 are chosen so as to pose questions or classifications which can be answered or matched by selecting appropriate ones of the letters 18 to spell words. Although the second indicia 22 has been shown as comprising words, it is specifically contemplated that the indicia can define other similar game categories or classifications.

It will be appreciated that the second indicia 22 is arranged in the column 26 in spaced relationship with the row 20 which contains the first indicia 16. Therefore, as shown in FIG. 1, third indicia 28 are provided on the playing surface 14 to associate the letters 18 with the game categories 24. The third indicia 28 comprises a grid of intersecting vertical and horizontal lines which define a plurality of parallel vertical columns 30 and a plurality of parallel horizontal rows 32. Each column 30 includes, at its head, one of the letters 18. Therefore, a single letter 18 is associated with each column 30, and the number of columns is equal to the number of letters. Similarly, each row 32 includes, at its left-hand margin, one of the game categories 24. Therefore, a single game category 24 is associated with each row 32, and the number of rows is equal to the number of game categories.

The intersection of each column 30 and row 32 defines a square-shaped playing area 34 (FIG. 1). For each such playing area 34, the letter 18 at the head of the column 30 which partially defines the playing area is thereby associated with the game category 24 at the left margin of the row 32 which further defines the playing area. A single combination of a letter 18 and a game category 24 is therefore associated with each playing area 34. And, accordingly, the number of playing areas 34 is equal to the product of the number of letters 18 and the number of game categories 24.

Each playing area 34 is initially blank and is preferably identical to every other playing area. The playing surface 14 of the card 12 is of a suitable material so that a selecting indicia can be placed in each playing area 34 by, for example a pencil, a pen or the like. As shown in FIG. 1, this indicia can be a letter 36 which corresponds to the letter 18 in the column in which the letter 36 is placed or it can be an "X" 38, a check mark (not shown) or other indicia which indicates selection of one of the playing areas 34.

Figure 3:
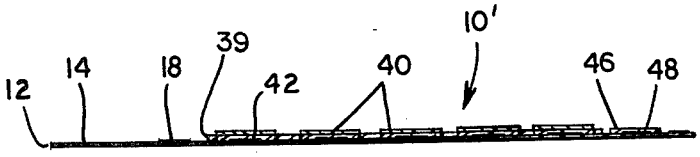
FIG. 3 is a cross-sectional view taken along the line 3—3 of the game shown in FIG. 2.

FIGS. 2 and 3 show an alternate construction of the game of the present invention. The elements of the game 10' are identical to those of the game 10 in FIG. 1, except for the construction of the playing areas. On the playing surface 14 of the game 10' is an opaque selectively removable masking layer 39. The masking layer 39 is printed on the playing surface 14, in a manner well known in the art. Printed over the masking layer 39 are a plurality of square-shaped indicia 40 which define a plurality of playing areas 34'. As with the playing areas 34 (FIG. 1) of the game 10, the playing areas 34' of the game 10' are arranged in parallel rows 32' and columns 30'. There is a row 32' of playing areas 34' for each game category 24 and a column 30' of playing areas for each letter 18. A single combination of a letter 18 and a game category 24 is therefore associated with each playing area 34'. A letter 18 is thereby associated with a game category 24 by removing, or scratching off, the portion of the mask 39 within the indicia 40 defining the game category 34' in an appropriate column 30' and row 32'.

Optionally printed on the playing surface 14 between the playing surface and the mask 39 is a fourth indicia. The fourth indicia can comprise a letter 42 identical to the letter 18 at the head of the column 30', it can comprise a picture (not shown), a word 44 to indicate a winning card or the like. When the letters 42 are provided under the playing areas 34', it makes it easier to read the word spelled out by the removal of the selected portions of the mask 39. When an instant winner designation, such as the word 44, is provided under the mask 39, the word can be randomly arranged under the playing areas 34' to provide an element of chance to the game.

Also optionally printed on the playing surface 14 of the game 10' is a selectively removable opaque prize mask 46. The prize mask 46 is identical in nature to the other mask 39 and can be printed simultaneously with the other mask. The prize mask 46, however, does not correspond to the letters 18 or the game categories 24 and is not arranged in the rows 32' or columns 30'. Printed on the playing surface 14 between the playing surface and the prize mask 46 is a fifth indicia 48 which can designate a secret prize, such as a "COLA".

Operation of the game of the present invention will now be considered. It is an object of the game to select letters 18 to spell words which correspond to the game categories 24. It is an additional object to spell words using all the letters 18 but to use each letter only once.

In the game 10 shown in FIG. 1 a word corresponding to a game category is spelled by placing an indicia, such as a letter 36, an "X" 38 or other indicia, in the column 30 containing the selected letter 18 and the row containing the selected game category. Only one indicia is placed in any one column 30. For example, the first game category 24 is "ANIMAL." Letters 18 are therefore selected to spell words which are animals. From the letters 18, it is possible to spell several different animals: dog, doe, fly, goose, etc. The letters 18 to spell the word selected for the animal game category are then indicated by placing an indicia in an appropriate playing area 34 in the first row 32. As shown in FIG. 1, the letters 36 "D," "O" and "G" have been placed in the playing areas 34 of the first row 32 and of the columns 30 (FIG. 1) containing the letters 18 "D," "O" and "G." Similarly, the portion of the mask 39 corresponding to the playing areas 34' of the first row 32' and of the columns 30' containing the letters 18 "D," "O" and "G" have been removed to reveal the letters 42 "D," "O" and "G" therebelow (FIG. 2). It should also be noted that the same word "DOG" can be spelled using different combinations of the letters 18. That is, the word "DOG" can be spelled using either the "O" in the fifth column 30 or the "O" in the seventh column.

There is at least one combination of playing areas 34 which will use only once all of the letters 18 to spell a word that describes each of the five game categories 24. However, there is also at least one combination of playing areas 34 which, although they spell words that describe each of the game categories 24, used one or more of the letters 18 more than once. Therefore, there are several possible solutions to the game categories, but there is at least one solution, and preferably only one solution, which uses each letter 18 only once. The game of the present invention therefore involves an element of skill for a player to determine which letters, or which combination of letters, will provide a solution for each game category, but which will use each letter 18 only once. If a player solves the game 10 using each letter 18 only once, the card is a "winner" and can be redeemed for an appropriate prize.

When the game 10' uses the secret winning indicia 44 an additional element of chance is introduced into the game. A player must not only solve each game category 24 using all of the letters 18 only once, he must also select the mask 40 under which the winning indicia 44 is printed. For example, on the card in FIG. 2, for the game category 24 "MINERAL", the word selected, and for which the portions of the mask 39 have been removed, is the word "GOLD." Underlying the letter "L" in that selection is the word "WIN" 44. Had the word "GOLD" been spelled using the "L" in the eighth column 30', rather than the "L" in the ninth column, the winning indicia 44 would not have been uncovered.

To add an additional element of suspense to the game 10', the prize for which the card can be redeemed when the winning indicia 44 is uncovered is hidden under the prize mask 46. Therefore, when the winning indicia 44 is uncovered, the prize mask 46 is removed and the card is redeemed for the prize identified by the prize indicia 48, which on the card shown in FIG. 2 is "COLA."

Although the present invention has been described as having parallel vertical columns and parallel horizontal rows, it is specifically contemplated that other geometric configurations of the elements can also be used. For example, the letters can run vertically, rather than horizontally; and the game categories can run horizontally, rather than vertically. Alternately, the columns can extend radially and the rows concentrically. Other configurations will also be apparent to those of skill in the art.

It is also specifically contemplated that different letters or game symbols and different game categories or classifications can be used, while still retaining the object of the invention.

When the game 10 is used it is specifically contemplated that the selecting indicia, such as the letter 36 of the "x" 38, can be detected by electronic or electromechanical devices, such as by optical scanning devices, to facilitate the determination of winning cards. Such devices could also be used to detect the removed portions of the mask 39 corresponding to the selected playing areas 34' of the game 10' to thereby determine winning cards.

It will be understood, of course, that the foregoing relates only to preferred embodiments of the present invention, and that numerous modifications or alterations can be made therein without departing from the spirit and scope of the invention as set forth in the appended claims.

We claim:

1. A game comprising:

a playing surface; first indicia on said playing surface defining a plurality of game symbols;

second indicia on said playing surface defining a plurality of game categories, said second indicia being arranged on said playing surface so that said game symbols are in spaced relationship with said game categories;

third indicia on said playing surface defining a plurality of selectable playing areas, each of said playing areas being in spaced register with one of said game symbols and one of said game categories so that selection of a particular one of said playing areas associates a particular one of said game symbols with a particular one of said game categories; and a preselected plurality of said playing areas defining at least one predetermined game symbol combination bearing a predetermined relationship to one of said game categories, said game symbol combination comprising a predetermined sequence of said game symbols and each one of said game symbols being associated with only one game symbol combination, whereby the selection of a particular predetermined game symbol combination for each of said game categories wins the game.

2. A game comprising:

a playing surface;

first indicia on said playing surface defining a plurality of game symbols;

second indicia on said playing surface defining a plurality of game categories; third indicia on said playing surface defining a plurality of intersecting rows and columns;

said first indicia and said third indicia being arranged on said playing surface so that each said game symbol is associated with a different one of said columns;

said second indicia and said third indicia being arranged on said playing surface so that each said game category is associated with a different one of said rows;

said intersection of said columns and said rows defining a plurality of selectable playing areas such that the selection of a particular playing area associates the game symbol associated with the column which includes the selected playing area with the game category associated with the row which includes the selected playing area; and a preselected plurality of said playing areas defining a predetermined number of game symbol combinations bearing a predetermined relationship to one of said game categories, each of said game symbol combinations comprising a predetermined sequence of said game symbols and each one of said game symbols being associated with only one game symbol combination, whereby the selection of a particular predetermined combination of said playing areas uniquely selects predetermined ones of said game symbol combinations to win the game.

3. A game comprising:

a playing surface;

first indicia on said playing surface defining a plurality of game symbols;

second indicia on said playing surface defining a plurality of game categories, said second indicia being arranged on said playing surface so that said game symbols are in spaced relationship with said game categories;

third indicia on said playing surface defining a plurality of selectable playing areas, each of said playing areas being in spaced register with one of said game symbols and one of said game categories so that selection of a particular one of said playing areas associates a particular one of said game symbols with a particular one of said game categories; and a preselected plurality of said playing areas defining a predetermined number of game symbol combinations, at least one of said game symbol combinations bearing a predetermined relationship to each one of said game categories, each of said game symbol combinations comprising a predetermined sequence of said game symbols and each one of said game symbols being associated with only one game symbol combination, whereby the selection of a particular predetermined combination of said playing areas uniquely selects particular predetermined ones of said game symbol combinations to win the game.

4. The game of claims 1, 2 or 3 wherein the game symbols are letters of the alphabet.

5. The game of claims 1, 2 or 3 wherein said desired combinations of game symbols spell words.

6. The game of claims 1, 2 or 3 wherein each said game category identifies a different question.

7. The game of claims 1, 2 or 3 further comprising:

fourth indicia printed on said playing surface and disposed within at least one of said playing areas; and a selectively removable masking layer disposed on each said playing area to visually hide indicia disposed in said playing areas.

8. The game of claim 1, 2, or 3 wherein all of said game symbols are associated with a game symbol combination to win the game.

9. A game comprising:

a playing surface;

first indicia on said playing surface defining a plurality of game symbols;

second indicia on said playing surface defining a plurality of game categories, said second indicia being arranged on said playing surface so that said game symbols are in spaced relationship with said game a plurality of selectable playing areas, each of said playing areas being in spaced register with one of said game symbols and one of said game categories so that removal of a portion of said masking layer selects one of said playing areas and associates a particular one of said playing symbols with a particular one of said game categories; and a preselected plurality of said playing areas defining at least one predetermined game symbol combination bearing a predetermined relationship to one of said game categories, said game symbol combination comprising a predetermined sequence of game symbols and each one of said game symbols being associated with only one game symbol combination, whereby the selection of a particular predetermined game symbol combination for each of said game categories wins the game.

10. The game of claim 9, further comprising third indicia between said playing surface and said masking layer so that said masking layer visually hides said third indicia.

11. The game of claim 10 wherein said game symbols and said third indicia are letters of the alphabet.

12. The game of claim 10 wherein said third indicia defines a second game symbol between said masking layer and said playing surface and said second game symbol is the same as said game symbol associated with said playing area.

13. The game of claim 9 wherein two or more of said predetermined game symbol combinations is associatable with each game category and only one of said predetermined combinations associates all of said game symbols with all of said game categories.

14. The game of claim 9 wherein one or more of said predetermined game symbol combinations is associatable with each game category and only one of said predetermined combinations associates all of said game symbols with all of said game categories.

15. The game of claim 9 further comprising indicia on said masking layer defining said playing areas.

16. A game comprising:

a playing surface;

first indicia on said playing surface defining a plurality of alphabetical letters;

second indicia on said playing surface defining a plurality of game categories, said second indicia being arranged on said playing surface so that said game letters are in spaced relationship with said game categories;

third indicia on said playing surface defining a plurality of selectable playing areas, each of said playing areas being in spaced register with one of said game letters and one of said game categories so that selection of a particular one of said playing areas associates a particular one of said game letters with a particular one of said game categories; and a preselected plurality of said playing areas defining at least one predetermined game letter combination which spells a word related to one of said game categories, whereby the selection of a particular predetermined word for each of said game categories wins the game.

17. The game of claim 16, wherein said plurality of said playing areas define a plurality of game letter combinations which spell a plurality of words, and wherein each one of said plurality of words is related to one of said game categories.

18. The game of claim 17, wherein each one of said plurality of said playing areas is associated with only one of said plurality of words, whereby each game letter is used only once to spell a word.

19. The game of claim 17, wherein each one of said plurality of said game letter combinations comprises a predetermined sequence of said game letters, whereby said game letters spell a word by selection of said game letters in a particular order.

20. The game of claim 16, wherein at least one combination of said playing areas associates all of said game letters to spell a plurality of words, and wherein each one of said plurality of words is related to one of said game categories, and wherein the selection of a particular predetermined word for each of said game categories wins the game.

* * * * *